US008051783B1

(12) United States Patent
Hoskinson

(10) Patent No.: US 8,051,783 B1
(45) Date of Patent: Nov. 8, 2011

(54) DISPLAY TABLE ASSEMBLY

(76) Inventor: Shell L. Hoskinson, Clarksburg, WV (US)

( * ) Notice: Subject to any disclaimer, the term of this patent is extended or adjusted under 35 U.S.C. 154(b) by 309 days.

(21) Appl. No.: 12/420,312

(22) Filed: Apr. 8, 2009

(51) Int. Cl.
*A47B 37/00* (2006.01)

(52) U.S. Cl. ..... 108/50.02; 108/25; 108/23; 108/50.01

(58) Field of Classification Search ..... 108/26, 108/25, 23, 33, 38, 35, 36, 50.01, 50.02; 312/244, 236, 223.3, 223.6
See application file for complete search history.

(56) References Cited

U.S. PATENT DOCUMENTS

| | | | | | |
|---|---|---|---|---|---|
| 1,211,829 | A | * | 1/1917 | Eades | 108/35 |
| 1,392,726 | A | * | 10/1921 | Watkins | 434/407 |
| 2,683,639 | A | * | 7/1954 | Brenny | 108/26 |
| 2,942,921 | A | * | 6/1960 | Rachman et al. | 108/26 |
| 3,156,510 | A | * | 11/1964 | Hindin et al. | 108/23 |
| 3,917,275 | A | * | 11/1975 | Alpher | 108/25 |
| 4,094,256 | A | * | 6/1978 | Holper et al. | 108/50.02 |
| 4,120,248 | A | | 10/1978 | Broach | |
| 4,321,873 | A | | 3/1982 | Nealis | |
| D270,399 | S | | 9/1983 | Miller | |
| 4,437,714 | A | * | 3/1984 | Struck | 108/25 |
| 4,807,095 | A | | 2/1989 | Bell | |
| 5,060,580 | A | * | 10/1991 | Shaw | 108/25 |
| 5,121,698 | A | * | 6/1992 | Kelley | 312/196 |
| 5,733,035 | A | | 3/1998 | Spencer et al. | |
| 5,876,262 | A | | 3/1999 | Kelly et al. | |
| 6,340,213 | B1 | * | 1/2002 | Calobrisi, Jr. | 108/25 |
| 6,823,802 | B2 | * | 11/2004 | Butts, Jr. | 108/25 |
| 2005/0028708 | A1 | * | 2/2005 | Lu et al. | 108/50.02 |
| 2011/0048288 | A1 | * | 3/2011 | Sheldon | 108/25 |

* cited by examiner

*Primary Examiner* — Jose V Chen

(57) ABSTRACT

A display table assembly includes a housing that has a bottom wall and a perimeter wall with an upper edge defining an opening extending into the housing. A plurality of legs extends downwardly from the bottom wall. An upper wall is hingedly coupled to the upper edge and is positionable in an open position exposing the opening or in a closed position closing the opening. The upper wall has a plurality of apertures extending therethrough. A power strip is mounted within the housing. Plug members are positionable in the apertures to plug the apertures. Multiple articles are positionable on the top side of the upper wall and each covers one of the apertures. Power cords for the articles are extendable through an associated one of the apertures to be plugged into the power strip.

8 Claims, 4 Drawing Sheets

DISPLAY TABLE ASSEMBLY

BACKGROUND OF THE DISCLOSURE

Field of the Disclosure

The disclosure relates to display tables and more particularly pertains to a new display table for displaying articles requiring electrical power while concealing the electrical cords for the articles.

SUMMARY OF THE DISCLOSURE

An embodiment of the disclosure meets the needs presented above by generally comprising a housing that has a bottom wall and a perimeter wall attached to and extending upwardly from the bottom wall. The perimeter wall has an upper edge defining an opening extending into the housing. A plurality of legs is attached to and extends downwardly from the bottom wall. An upper wall is hingedly coupled to the upper edge and is positionable in an open position exposing the opening or in a closed position closing the opening. The upper wall has a top side and a bottom side and the upper wall has a plurality of apertures extending therethrough. A power strip, including a plurality of female electrical sockets, is mounted within the housing and is mounted on the perimeter wall. A power supply cord electrically coupled to the power strip extends through the perimeter wall and is pluggable into an electrical power socket to supply power to the power strip. Each of a plurality of plug members has a size and shape to be positioned in one of the apertures and releasably engage a peripheral edge of an associated one of the apertures. Multiple articles are positionable on the top side of the upper wall and each covers one of the apertures. Power cords for the articles are extendable through an associated one of the apertures to be plugged into the power strip.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
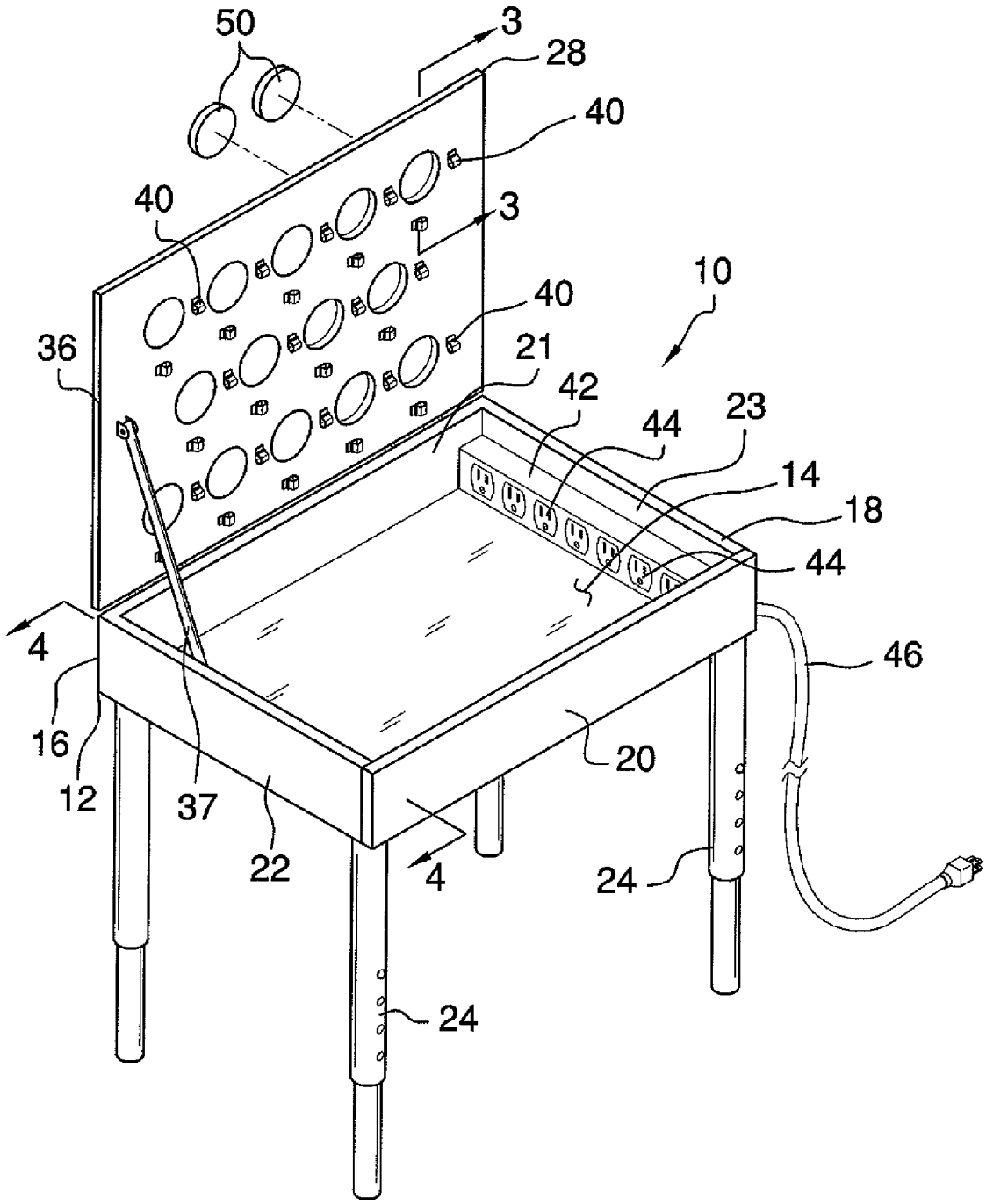
FIG. 1 is a top perspective view of a display table assembly according to an embodiment of the disclosure.
Figure 2:
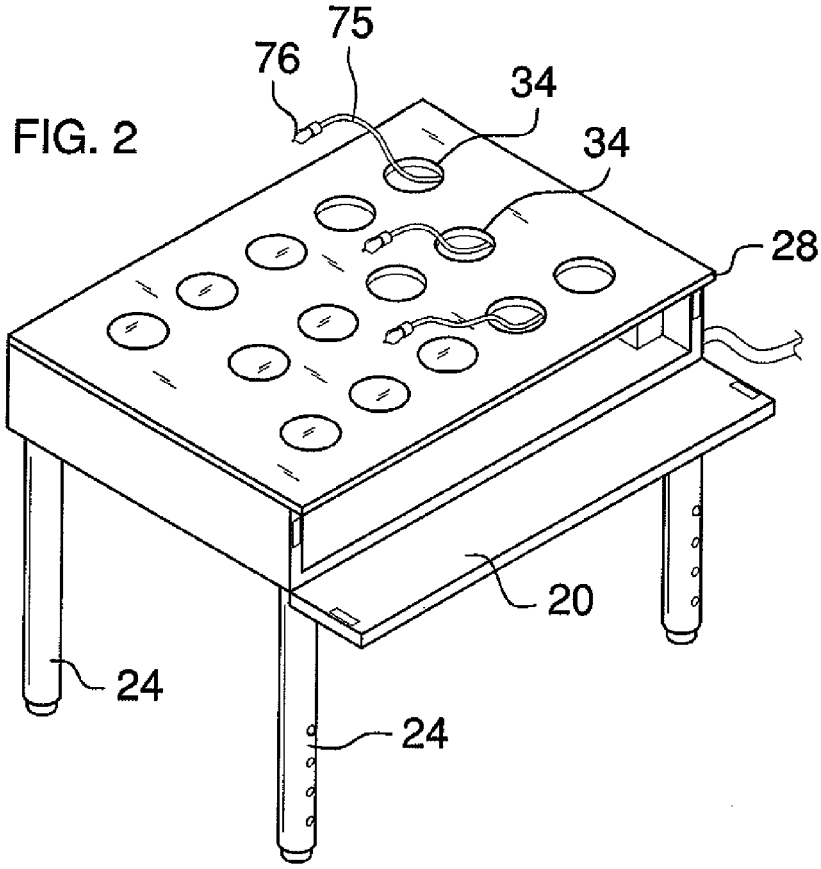
FIG. 2 is a top perspective view of an embodiment of the disclosure.
Figure 3:
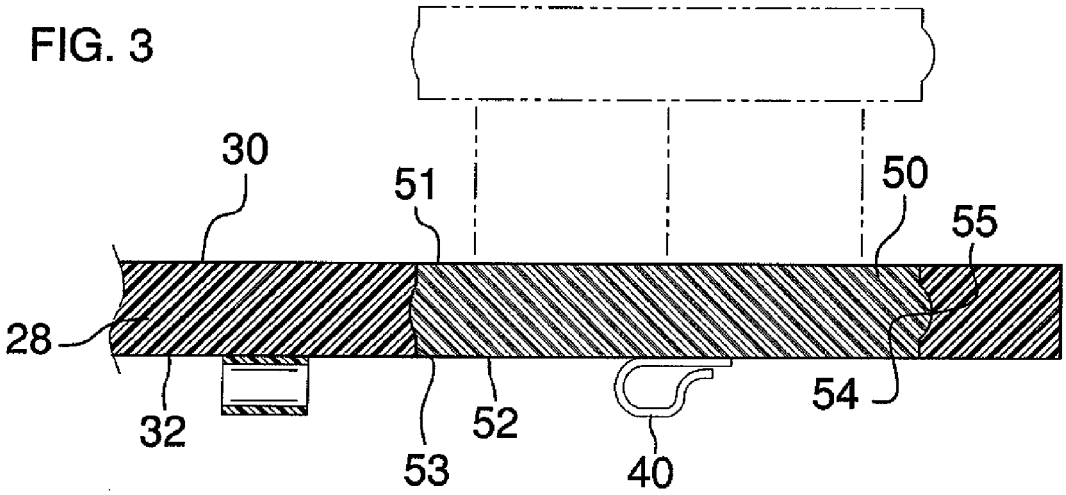
FIG. 3 is a cross-sectional view taken along line 3-3 of FIG. 1 of an embodiment of the disclosure.
Figure 4:
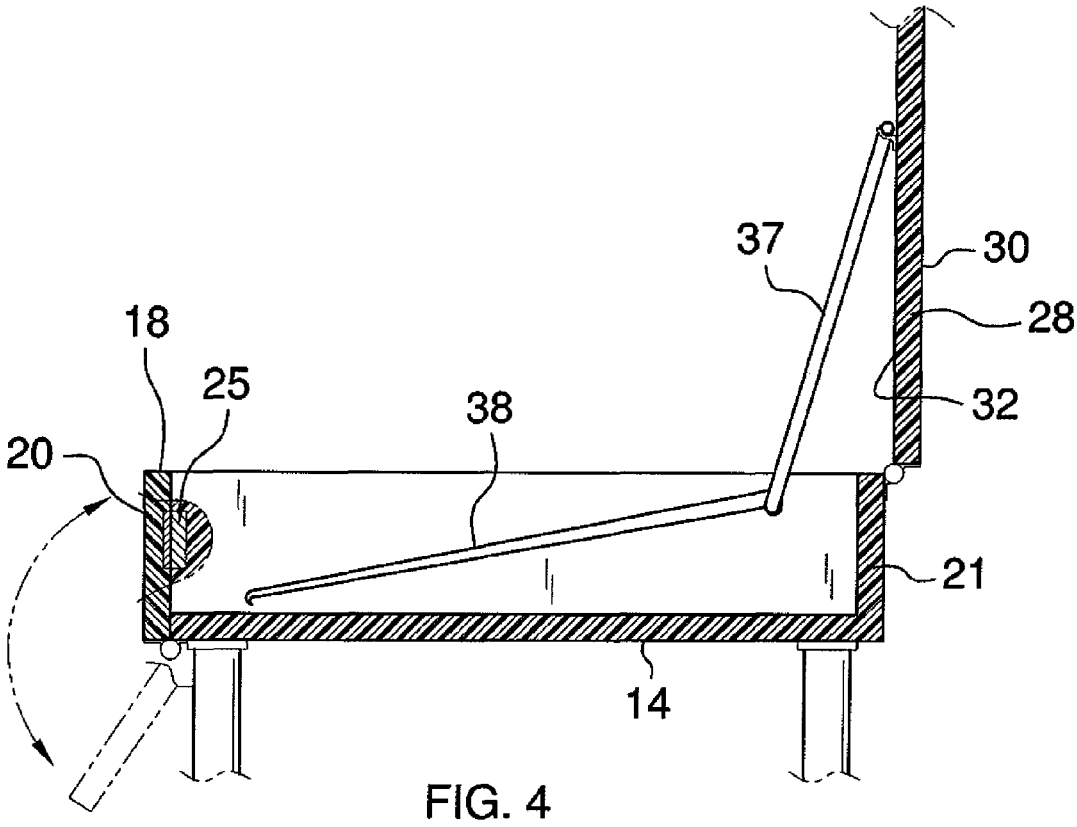
FIG. 4 is a cross-sectional view taken along line 4-4 of FIG. 1 of an embodiment of the disclosure.
Figure 5:
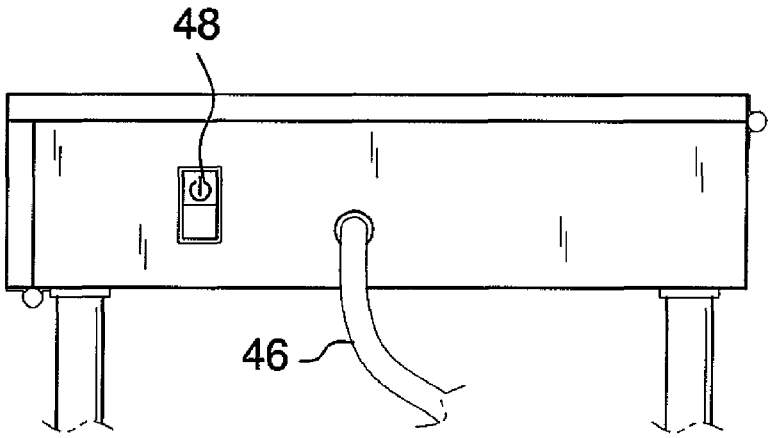
FIG. 5 is a side view of an embodiment of the disclosure.
Figure 6:
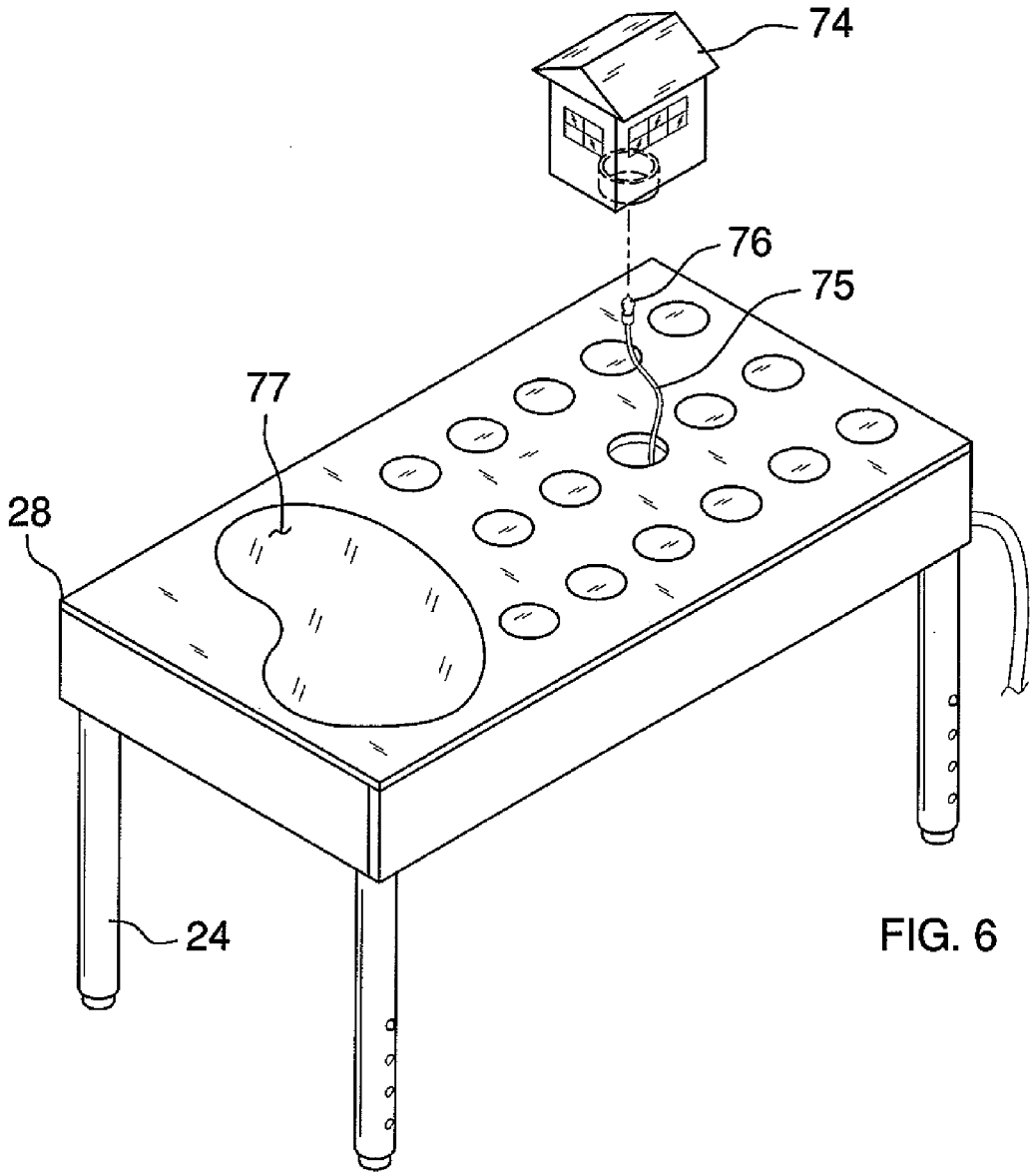
FIG. 6 is an in-use perspective view of an embodiment of the disclosure.

With reference now to the drawings, and in particular to FIGS. 1 through 6 thereof, a new display table embodying the principles and concepts of an embodiment of the disclosure and generally designated by the reference numeral 10 will be described.

As best illustrated in FIGS. 1 through 6, the display table assembly 10 generally comprises a housing 12 that has a bottom wall 14 and a perimeter wall 16 which is attached to and extends upwardly from the bottom wall 14. The perimeter wall 16 has an upper edge 18 defining an opening extending into the housing 12. The perimeter wall 16 includes a front wall 20, a rear wall 21, a first lateral wall 22 and a second lateral wall 23. The front wall 20 is hingedly coupled to the front wall 20 to allow the front wall 20 and is positionable in an upright position or in an extended position extending laterally away from the bottom wall 14. A magnetic latch 25 releasably retains the front wall 20 in the upright position. The perimeter wall 16 has a height between 3 inches and 12 inches and the bottom wall 14 has a length and width each between 20 inches and 40 inches. A plurality of legs 24 is attached to and extends downwardly from the bottom wall 14. Each of the legs 24 is telescopic and has a selectively adjustable height.

An upper wall 28, or cover, is hingedly coupled to the upper edge 18. The upper wall 28 is positionable in an open position exposing the opening or in a closed position closing the opening. The upper wall 28 has a top side 30 and a bottom side 32. The upper wall 28 has a plurality of apertures 34 extending therethrough which extend downwardly into the top side 30 and through the bottom side 32. At least three of the apertures 34 are positioned within 4 inches of a perimeter edge 36 of the upper wall 28 and at least three of the apertures 34 are spaced at least 4 inches from the perimeter edge 36. The apertures 34 may be positioned in rows as is shown in the Figures. The apertures 34 are circular shaped and each has a diameter less than 3 inches. A support arm 37 is coupled to the upper wall to selectively retain the upper wall in the open position. The support arm 37 is slidably coupled to a guide rail 38.

A plurality of clips 40 is attached to a bottom side 32 of the upper wall 28. Each of the apertures 34 has at least one of the clips 40 positioned adjacent thereto. Power cords 75 for articles 74 positioned on the upper wall are securable to the top wall 28 with the clips 40. The clips retain the power cords 75 in an orderly arrangement and the power cords 75 will most often be used for powering items such as lights 76 positioned within the articles 74.

A conventional power strip 42 includes a plurality of female electrical sockets 44 mounted within the housing 12 on the perimeter wall 16. A power supply cord 46 electrically coupled to the power strip 42 extends through the perimeter wall 16 and is pluggable into an electrical power socket to supply power to the power strip. The power strip 42 includes a power actuator 48 to selectively supply or shut off electricity to the female electrical sockets 44. The power actuator 48 extends through the perimeter wall 16 so that it may be accessed outside of the housing 12.

A plurality of plug members 50 is provided. Each of the plug members 50 has a size and shape to be positioned in one of the apertures 34 and releasably engage a peripheral edge of an associated one of the apertures 34. In particular, each of the plug members 50 includes an upper wall 51, a lower wall 52 and a peripheral wall 53 extending between the upper 51 and lower 52 walls. The plug members 50 may be solid and the upper 51 and lower 52 walls comprise upper and lower surfaces. The peripheral wall 53 includes a peripheral flange 54 that it is extendable into a peripheral trough 55 in the peripheral edge of the apertures 34. The flanges 54 frictionally engage the troughs 55 to retain the plug members 50 in place and to allow items to be placed on the plug members 50 without the plug members 50 falling out of the apertures 34. The upper sides 51 of the plug members 50 are flush with the top side 30 of the upper wall 28 when the plug members 50 are places in the apertures 34.

In use, multiple articles 74, such as for example miniaturized dwellings used for holiday decorating, are positionable on the top side 30 of the upper wall 28 and positioned such that each article 74 covers one of the apertures 34. Power cords 75 for the articles 74 are extendable through an associated and covered one of the apertures 34 to be plugged into the power strip 42. This allows the power cords 75 to remain hidden from view when the articles 74 are displays and illuminated. Other decorative features, such as mirrors 77 or other decorative elements not requiring electrical power can be positioned on the upper wall 28 as needed while using the plug members 50.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A display table assembly comprising:

a housing having a bottom wall and a perimeter wall being attached to and extending upwardly from said bottom wall, said perimeter wall having an upper edge defining an opening extending into said housing;

a plurality of legs being attached to and extending downwardly from said bottom wall;

an upper wall being coupled to said upper edge, said upper wall being positionable in an open position exposing said opening or in a closed position closing said opening, said upper wall having a top side and a bottom side, said upper wall having a plurality of apertures extending therethrough;

a power strip including a plurality of female electrical sockets being mounted within said housing and being mounted on said perimeter wall, a power supply cord electrically coupled to said power strip extending through said perimeter wall and being pluggable into an electrical power socket to supply power to said power strip;

a plurality of plug members, each of said plug members having a size and shape to be removably positioned in and plug one of said apertures; and wherein said top side is configured to support multiple articles positioned on said top side of said upper wall, each of said apertures being configured to be covered by one of the articles, wherein said power strip is configured to be electrically coupled to power cords which are extendable through said apertures.

2. The assembly according to claim 1, wherein said perimeter wall includes a front wall, a rear wall, a first lateral wall and a second lateral wall, said front wall being hingedly coupled to said front wall to allow said front wall and being positionable in an upright position or in an extended position extending laterally away from said bottom wall.

3. The assembly according to claim 1, wherein each of said legs is telescopic and having a selectively adjustable height.

4. The assembly according to claim 1, wherein at least three of said apertures is positioned within 4 inches of a perimeter edge of said upper wall, at least three of said apertures being spaced at least 4 inches from said perimeter edge.

5. The assembly according to claim 1, further including a plurality of clips being attached to a bottom side of said upper wall, each of said apertures having at least one of said clips positioned adjacent thereto, wherein power cords for articles positioned on said upper wall are securable to said top wall with said clips.

6. The assembly according to claim 5, further including a plurality of clips being attached to a bottom side of said upper wall, each of said apertures having at least one of said clips positioned adjacent thereto, wherein power cords for articles positioned on said upper wall are securable to said top wall with said clips.

7. The assembly according to claim 1, wherein said power strip includes a power actuator to selectively supply or shut off electricity to said female electrical sockets, said power actuator extending through said perimeter wall.

8. A display table assembly comprising:

a housing having a bottom wall and a perimeter wall being attached to and extending upwardly from said bottom wall, said perimeter wall having an upper edge defining an opening extending into said housing, said perimeter wall including a front wall, a rear wall, a first lateral wall and a second lateral wall, said front wall being hingedly coupled to said front wall to allow said front wall and being positionable in an upright position or in an extended position extending laterally away from said bottom wall, said perimeter wall having a height between 3 inches and 12 inches, said bottom wall having a length and width each between 20 inches and 40 inches;

a plurality of legs being attached to and extending downwardly from said bottom wall, each of said legs being telescopic and having a selectively adjustable height;

an upper wall being hingedly coupled to said upper edge by a hinge, said upper wall being positionable in an open position exposing said opening or in a closed position closing said opening, said upper wall having a top side and a bottom side, said upper wall having a plurality of apertures extending therethrough, at least three of said apertures being positioned within 4 inches of a perimeter edge of said upper wall, at least three of said apertures being spaced at least 4 inches from said perimeter edge;

a plurality of clips being attached to a bottom side of said upper wall, each of said apertures having at least one of said clips positioned adjacent thereto, wherein power cords for articles positioned on said upper wall are securable to said top wall with said clips;

a power strip including a plurality of female electrical sockets being mounted within said housing and being mounted on said perimeter wall, a power supply cord electrically coupled to said power strip extending through said perimeter wall and being pluggable into an electrical power socket to supply power to said power strip, said power strip including a power actuator to selectively supply or shut off electricity to said female electrical sockets, said power actuator extending through said perimeter wall;

a plurality of plug members, each of said plug members having a size and shape to be removably positioned in and plug one of said apertures; and wherein said top side is configured to support multiple articles positioned on said top side of said upper wall, each of said apertures being configured to be covered by one of the articles, wherein said power strip is configured to be electrically coupled to power cords which are extendable through said apertures.

* * * * *